US012091940B2

(12) United States Patent
Jiang et al.

(10) Patent No.: US 12,091,940 B2
(45) Date of Patent: Sep. 17, 2024

(54) DEVICE FOR GRINDING SIDE SURFACE OF INNER WALL OF ROCK BOREHOLE

(71) Applicant: Institute of Rock and Soil Mechanics, CAS, Wuhan (CN)

(72) Inventors: Quan Jiang, Wuhan (CN); Pengfei Chen, Wuhan (CN); Jie Xin, Wuhan (CN); Herui Zhao, Wuhan (CN)

(73) Assignee: INSTITUTE OF ROCK AND SOIL MECHANICS, CAS, Wuhan (CN)

( * ) Notice: Subject to any disclaimer, the term of this patent is extended or adjusted under 35 U.S.C. 154(b) by 121 days.

(21) Appl. No.: 17/903,990

(22) Filed: Sep. 6, 2022

(65) Prior Publication Data

US 2024/0011354 A1 Jan. 11, 2024

(30) Foreign Application Priority Data

Jul. 6, 2022 (CN) ..... 202210798217.6

(51) Int. Cl.
*E21B 37/02* (2006.01)
*E21B 49/00* (2006.01)

(52) U.S. Cl.
CPC ..... *E21B 37/02* (2013.01); *E21B 49/006* (2013.01)

(58) Field of Classification Search
CPC ..... E21B 7/00; E21B 37/02; E21B 49/06; B24B 5/40; B24B 5/48
See application file for complete search history.

(56) References Cited

U.S. PATENT DOCUMENTS 2,181,980 A * 12/1939 Seale ..... E21B 49/06 175/254
2,304,330 A * 12/1942 Bannister ..... E21B 31/107 166/55.7
2,546,668 A * 3/1951 Kirby ..... E21B 49/06 173/19
6,026,915 A * 2/2000 Smith ..... E21B 17/1078 166/264
10,381,899 B2 * 8/2019 Feng ..... E21B 49/06
2017/0214291 A1 * 7/2017 Feng ..... E21B 49/06
2024/0011354 A1 * 1/2024 Jiang ..... E21B 4/18
2024/0012173 A1 * 1/2024 Jiang ..... G01V 9/00

FOREIGN PATENT DOCUMENTS

CN 113006739 A * 6/2021 ..... E21B 37/00
CN 115184171 A * 10/2022 ..... G01V 9/00

* cited by examiner

*Primary Examiner* — Jennifer H Gay
(74) *Attorney, Agent, or Firm* — Porter Wright Morris & Arthur LLP

(57) ABSTRACT

A device for grinding a side surface of an inner wall of a borehole comprises a base on which a direct current motor is installed on the base, one end of the direct current motor is electrically connected to a controller, and the other end of the direct current motor is in drive connection with a second rotating shaft of a right-angle drive steering gear by a universal drive joint. The controller is connected to an air pressure valve by a cable, and the air pressure valve is connected to an air pump through an air pipe. One end, away from the universal drive joint, of the right-angle drive steering gear is provided with a grinding cylinder. Grinding heads are respectively connected to first rotating shafts at both sides of the right-angle drive steering gear.

8 Claims, 5 Drawing Sheets

DEVICE FOR GRINDING SIDE SURFACE OF INNER WALL OF ROCK BOREHOLE

CROSS REFERENCE TO RELATED APPLICATION

This patent application claims the benefit and priority of Chinese Patent Application No. 202210798217.6, filed on Jul. 6, 2022, the disclosure of which is incorporated by reference herein in its entirety as part of the present application.

TECHNICAL FIELD

The present disclosure relates to the technical field of geotechnical engineering, and in particular relates to a device for grinding a side surface of an inner wall of a rock borehole.

BACKGROUND ART

At present, the commonly-used in-situ measurement instrument for rock modulus in engineering is a borehole jack. There are two types of borehole jacks at present: one is that "capsule" loading is utilized to perform uniform load on the wall of the rock borehole, its measured result is an average value of elastic modulus of rock in all directions, and the measurement error for fractured rock mass is large; the other is that a strip-shaped rigid loading plate with a radian section is used to measure the elastic modulus of the rock borehole in different directions. Because most of the rocks are anisotropic, this method is mostly used at present. However, such method does not treat the curved inner wall of the rock borehole, and the contact area of the rigid loading plate and surrounding rock is small, leading to a large difference between the measurement result and the calculation result.

In view of the traditional in-situ measurement method for the rock elasticity only for the existing rock borehole, due to the fundamental boundedness of the curved side surface of the inner wall of the rock borehole, a pressure head of the traditional in-situ measurement device cannot be completely matched with the side surface of the inner wall of the rock borehole. Thus, the problems that the measured values are easily affected by borehole wall factors and the loading pressure distribution of loading cell is not uniform exist. The error of incomplete contact between the measuring pressure head and the side surface cannot be fundamentally eliminated although many scholars and technicians keep making improvements, and there is also a large error in the test result of the rock's elastic modulus. Therefore, the structure of an existing elastic modulus tester does not meet the needs of geotechnical testing.

SUMMARY

An objective of the present disclosure is to provide a device for grinding a side surface of an inner wall of a rock borehole to overcome the problems in the prior art. A curved surface of the inner wall of the rock borehole may be ground to form two symmetric planes in parallel, such that a measuring pressure head for the rock's elastic modulus may be in full contact with the two ground surfaces of the inner wall of the rock borehole to reduce the measurement error of the elastic modulus of the rock.

To achieve the objective, the present disclosure provides the following solutions:

The present disclosure provides a device for grinding a side surface of an inner wall of a rock borehole, which is used for grinding side surfaces of inner walls of rock boreholes for in-situ measuring pressure head. The device comprises a base, a direct current motor is fixedly installed on the base, one end of the direct current motor is electrically connected to a controller, and the other end of the direct current motor is in drive connection with a second rotating shaft of a right-angle drive steering gear by a universal drive joint, thereby guaranteeing that the direct current motor may still provide a rotating force for the right-angle drive steering gear when the right-angle drive steering gear moves. The controller is connected to an air pressure valve by a cable, and the air pressure valve is connected to an air pump by an air pipe. One end, away from the universal drive joint, of the right-angle drive steering gear is provided with a grinding cylinder, and the grinding cylinder is fixedly installed on the base. A first translation movable plate and a second translation movable plate are symmetrically arranged at both sides of the right-angle drive steering gear, cylinder pistons at both sides of the grinding cylinder are fixedly connected to the first translation movable plate and the second translation movable plate respectively to guarantee the independent operation of two pistons of the grinding cylinder, and the effect that the grinding cylinder drives the translation movable plate to move left and right, and then the grinding heads are driven to move to grind the cambered surface of the inner wall of the rock borehole so as to form two parallel circular planes with two symmetrical borehole axes inside the rock borehole is achieved. One side of the right-angle drive steering gear is fixedly installed on the first translation movable plate, the other side of the right-angle drive steering gear is fixedly installed on the second translation movable plate, and first rotating shafts at both sides of the right-angle drive steering gear are fixedly connected to grinding heads after penetrating through the first translation movable plate and the second translation movable plate respectively, thereby guaranteeing that the direct current motor still provides rotating power when the right-angle drive steering gear moves to make the grinding heads rotate to grind the curved surface of the borehole wall. The grinding cylinder is connected to the air pressure valve by the grinding air pipe; and a displacement sensor electrically connected to the controller is installed on the grinding cylinder.

Alternatively, an initial connecting direction of the direct current motor and the right-angle drive steering gear is a first direction, a connecting direction of the right-angle drive steering gear and the grinding head is a second direction, and when viewed from the direct current motor toward the right-angle drive steering gear, a right-end direction of the second direction is a positive direction, a left-end direction of the second direction is a negative direction, and a connecting direction of the right-angle drive steering gear and the base is a third direction. A first linear bearing housing and a second linear bearing housing are provided between the first translation movable plate and the second translation movable plate, and are both arranged at one side of the right-angle drive steering gear in the first direction and without the direct current motor. The first linear bearing housing is arranged at a position away from the right-angle drive steering gear, and the second linear bearing housing is arranged at a position close to the right-angle drive steering gear. The first linear bearing housing and the second linear bearing housing are fixedly installed on the base, and the first translation movable plate is arranged at the right side seen from the connecting direction from the direct current motor to the right-angle drive steering gear. The second translation movable plate is arranged at the left side seen from the connecting direction from the direct current motor to the right-angle drive steering gear, and the first translation movable plate and the second translation movable plate are arranged in parallel and opposite to each other in the first direction. The first linear bearing housing is threaded to the base by screws penetrating through two first linear bearing housing threaded holes and two base perforations at opposite positions. The second linear bearing housing is threaded to the base by screws penetrating through two second linear bearing housing threaded holes and two base perforations at opposite positions. The first linear bearing housing and the second linear bearing housing are respectively located at two ends of the grinding cylinder. Under the limitation of the first translation movable plate and the second translation movable plate, the grinding heads driven by the right-angle drive steering gear may only displace horizontally in the second direction. Specifically, both ends of a first linear bearing housing LM (linear motion) shaft are threaded, and the first linear bearing housing LM shaft respectively penetrates through a first translation movable plate perforation and a second translation movable plate perforation to be fixed to the first translation movable plate and the second translation movable plate by nuts. Both ends of a second linear bearing housing LM shaft are threaded, and the second linear bearing housing LM shaft respectively penetrates through a first translation movable plate perforation and a second translation movable plate perforation to be fixed to the first translation movable plate and the second translation movable plate by nuts to guarantee the linear movement of the first translation movable plate and the second translation movable plate, thereby driving the grinding heads to move in a straight line to achieve the purpose of forming two parallel circular planes with two symmetrical borehole axes inside the rock borehole.

Alternatively, the end part of the grinding head is of a flat cylindrical structure, the tail part of the grinding head is of a long cylindrical structure, the bottom area of the flat cylindrical structure at the end part of the grinding head is greater than that of the long cylindrical structure at the tail part of the grinding head, and the end part of the grinding head is fixedly connected to the right-angle drive steering gear rotating shaft by the tail part of the grinding head.

Alternatively, the direct current motor is threaded to the base by threaded fasteners penetrating through direct current motor fixing holes.

Alternatively, the grinding cylinder is fixedly connected to the base through two symmetric L-shaped fixing plates. Specifically, the grinding cylinder is provided with four grinding cylinder threaded holes at both ends of the second direction, which are located at four vertex angles of each end, two side-by-side base threaded holes are provided at corresponding positions of the base, and the four grinding cylinder threaded holes and the two base threaded holes may be seen as two parallel lines in the third direction. Each L-shaped fixing plate is provided with a total of six L-shaped fixing plate threaded holes. The L-shaped fixing plate is provided with four L-shaped fixing plate threaded holes in the second direction to correspond to the grinding cylinder threaded holes, the L-shaped fixing plate is provided with two L-shaped fixing plate threaded holes in the third direction to correspond to the base threaded holes. Through the four L-shaped fixing plate threaded holes, the L-shaped fixing plate is fixed to the base by screws penetrating through the four grinding cylinder threaded holes provided oppositely, and through two remaining L-shaped fixing plate threaded holes in the third direction, the L-shaped fixing plate is fixed to the base by screws penetrating through two base threaded holes provided oppositely. Reset springs are respectively arranged at both ends of the grinding cylinder, one end of the reset spring located at one end of the grinding cylinder is fixed to the grinding cylinder by penetrating through the grinding cylinder hole, and the other end of the reset spring is fixed to the first translation movable plate by penetrating through a first parallel movable plate hole. One end of the reset spring located at the other end of the grinding cylinder is fixed to the grinding cylinder by penetrating through the grinding cylinder, and the other end of the reset spring is fixed to the second translation movable plate by penetrating through a second parallel movable plate hole. After the curved surface of the borehole wall is ground by the grinding heads, the cylinder is depressurized to a neutral position, and the grinding parts are reset to an initial state by the rebound of the reset springs.

Alternatively, the grinding cylinder is provided with two air introduction pipe openings which are arranged on the contact face of the grinding cylinder and the base in parallel in the second direction. Both ends of the grinding cylinder are respectively threaded to the two translation movable plates through piston rod threaded holes in the second direction, and cap nuts are located at the sides, away from the grinding cylinder, of the translation movable plates. The grinding cylinder is internally divided into a first grinding cylinder cavity and a second grinding cylinder cavity. The cylinder pistons located at both sides of the grinding cylinder are respectively located in the first grinding cylinder cavity and the second grinding cylinder cavity, and the first grinding cylinder cavity is connected to the air pressure valve by a second grinding air pipe, and the second grinding cylinder cavity is connected to the air pressure valve by a first grinding air pipe. The air pressure valve is connected to the grinding cylinder by the grinding air pipe so as to drive the grinding cylinder pistons to move in the second direction, the grinding cylinder pistons in the second direction drive the translation movable plates to move in the second direction, the translation movable plates drive the right-angle drive steering gear to move in the second direction, and the right-angle drive steering gear drives the grinding heads to move in the second direction.

Alternatively, the displacement sensor is threaded to the grinding cylinder by a screw penetrating through a grinding cylinder preformed hole via a displacement sensor hole. Both ends of the displacement sensor are connected to fixing strips through a sensor iron core, the fixing strips are tightly attached to the side surfaces of the grinding cylinder pistons, the fixing strips are fixed, and used to monitor the displacement of the grinding cylinder pistons in real time, thus determining the position information of the grinding cylinder pistons and the grinding planes. The outside of the displacement sensor is covered with a sealing cover, the sealing cover is fixed to the grinding cylinder by a nut penetrating through a sealing cover fixing hole and the corresponding grinding cylinder hole, and the sealing cover and a grinding cylinder are sealed with a sealing ring. The displacement sensor is connected to the controller by the cable through the displacement sensor hole, thus achieving the real-time monitoring and display of displacement measurement parameters of the grinding heads.

Alternatively, the controller comprises an input device and a display. The display may display air pressure parameter information and displacement parameter information of the grinding heads. Therefore, an operator may more intuitively read or observe in real time the changes in the air pressure and displacement parameters during the whole grinding process on the side surface of the inner wall of the rock borehole, and the providing of the display makes the use of the device for grinding the side surface of the inner wall of the rock borehole more conveniently.

Compared with the prior art, the present disclosure has the following technical effects:

In accordance with the device for grinding the side surface of the inner wall of the rock borehole, two symmetric planes parallel to each other are obtained inside the rock borehole, and the side surface grinding process has the advantages of high automation and visualization degree, no pollution, small and portable equipment. Specifically, the cylindrical rigid grinding head may be employed to grind the cambered surface of wall of the rock borehole, such that a measuring pressure head for elastic modulus is in full contact with two ground surfaces of the inner wall of the rock borehole to reduce the measurement error of the rock's elastic modulus. The use of an electric system, a pneumatic system and a controller makes the device of the present disclosure have high automation degree. The displacement sensor and the controller are used to read or observe in real time the changes in the air pressure and displacement parameters during the whole process of grinding the side surface of the inner wall of the rock borehole. Compared with a mode of pressurizing a power source using oil, a power transmission system employs electric power and compressed air as a hybrid power source, which reduces environmental pollution. The air pressure system of the device is recycled to reduce the energy consumption. The device has simple and small components with the size of about 50 cm×15 cm×10 cm and the weight of about 10 kg, such that the equipment is light and easy to carry.

BRIEF DESCRIPTION OF THE DRAWINGS

To describe the technical solutions in the embodiments of the present disclosure or in the prior art more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

Figure 1:
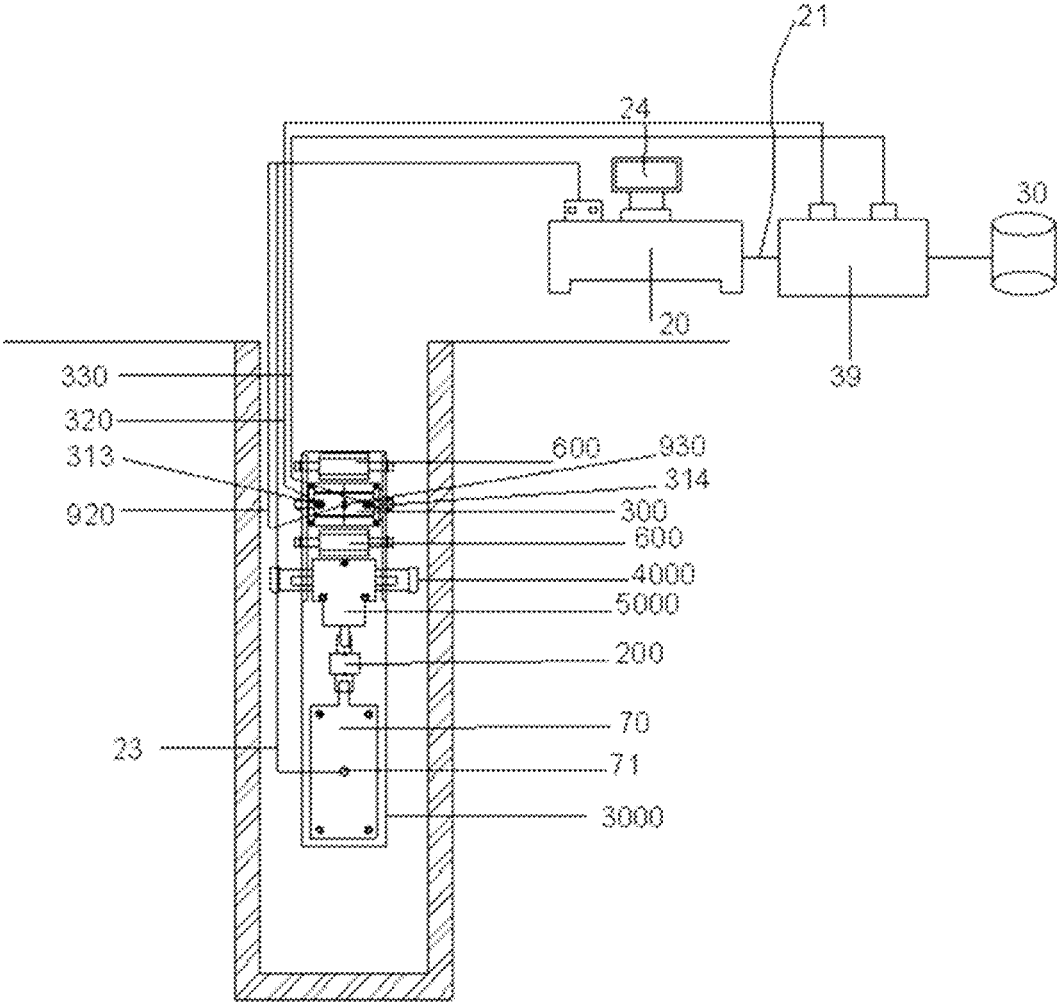
FIG. 1 is a schematic diagram of a structure of placing a device for grinding a side surface of an inner wall of a rock borehole in the rock borehole in accordance with the present disclosure.
Figure 2:
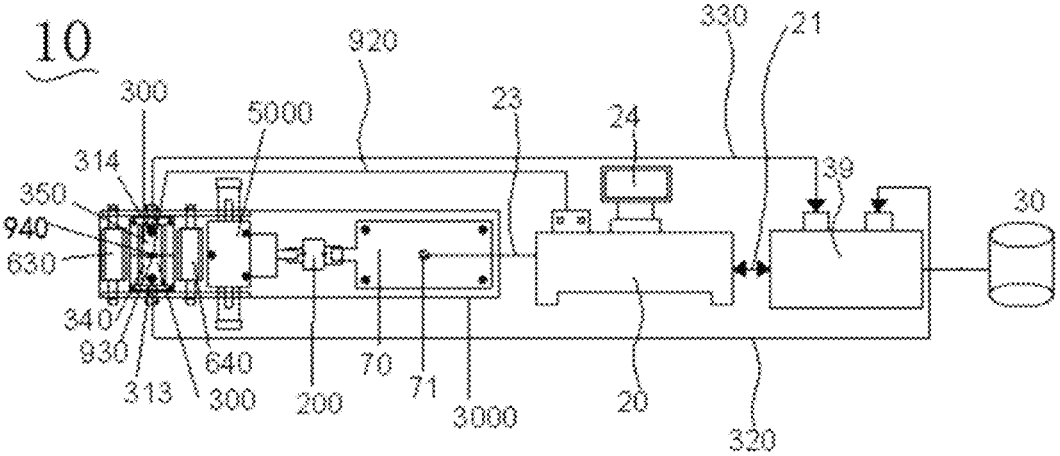
FIG. 2 is a schematic diagram of a detailed structure of a device for grinding a side surface of an inner wall of a rock borehole of FIG. 1.
Figure 3:
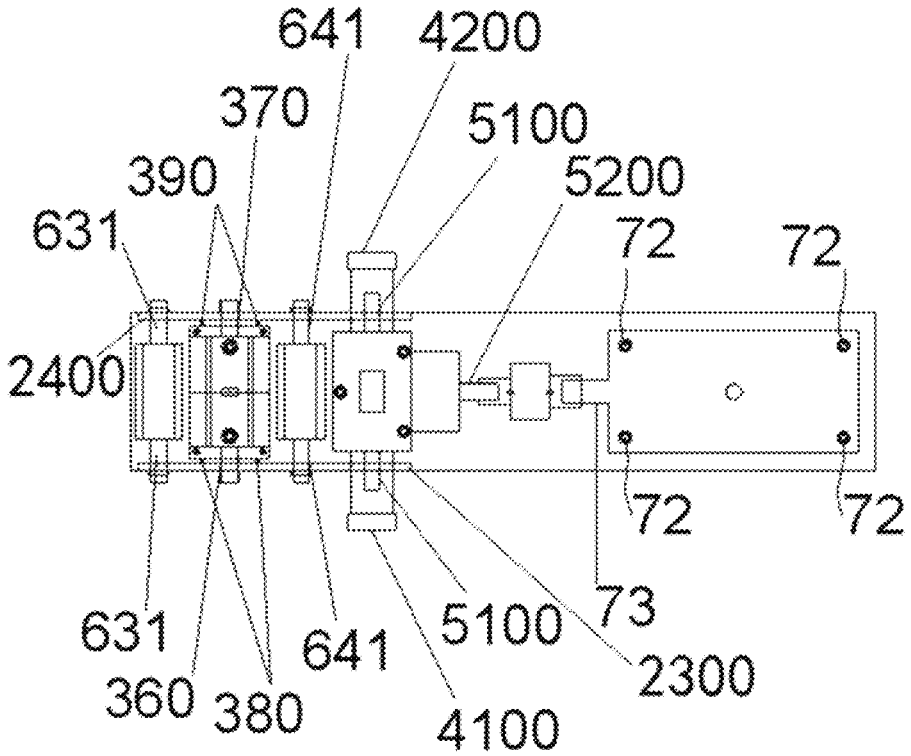
FIG. 3 is a sectional view of a device for grinding a side surface of an inner wall of a rock borehole in accordance with the present disclosure.
Figure 4:
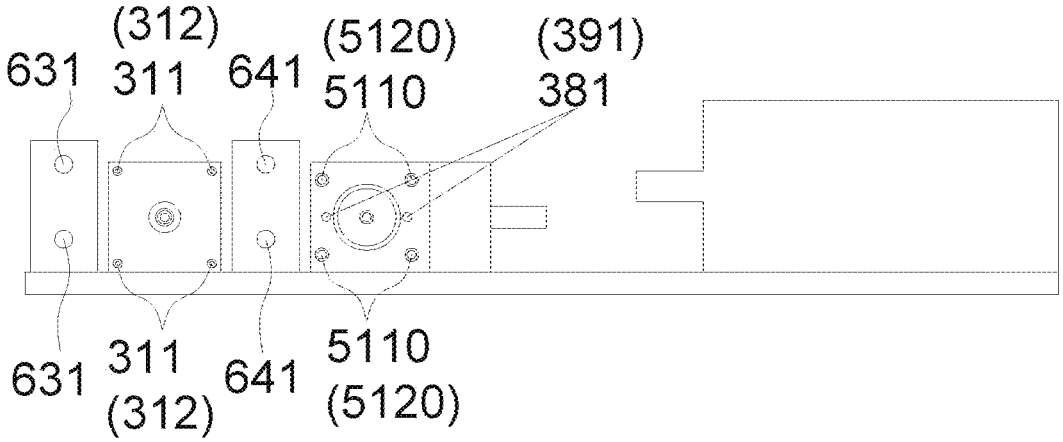
FIG. 4 is a sectional view of one side of a device for grinding a side surface of an inner wall of a rock borehole of FIG. 3.
Figure 5:
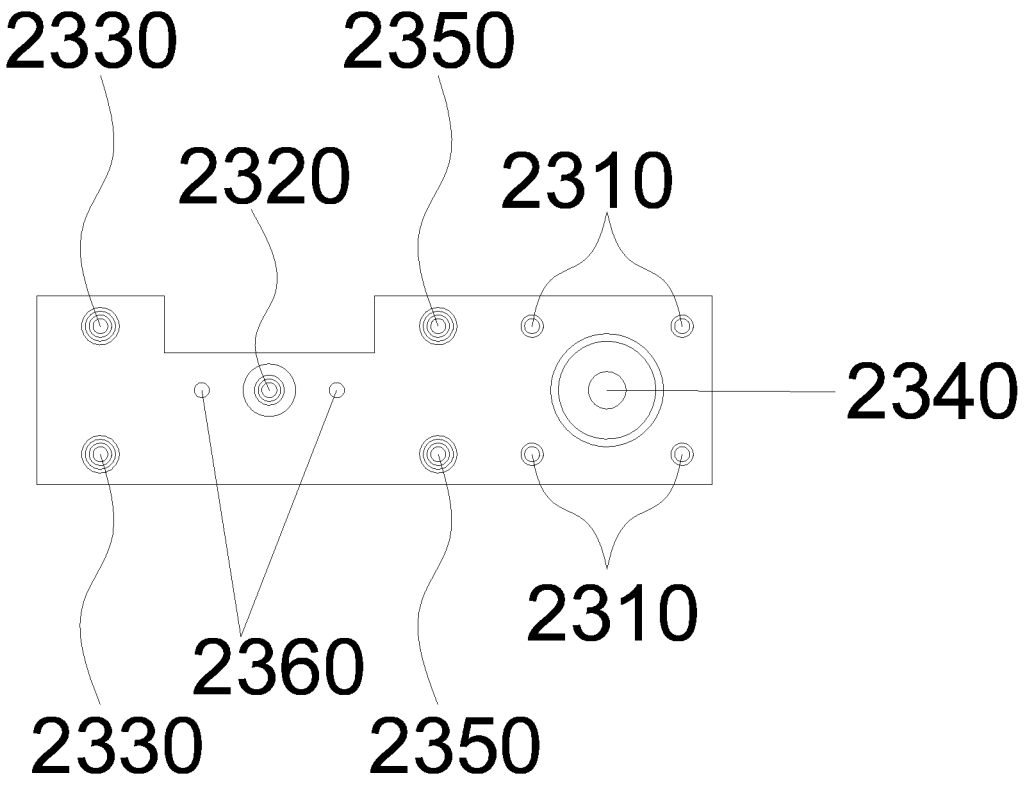
FIG. 5 is a schematic diagram of a structure of a first translation movable plate.
Figure 6:
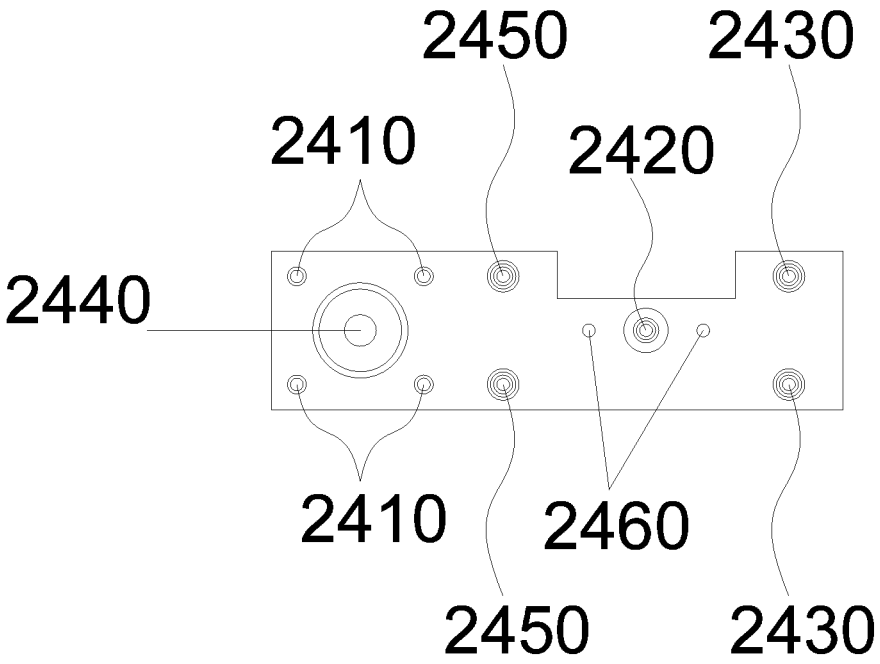
FIG. 6 is a schematic diagram of a structure of a second translation movable plate.
Figure 7:
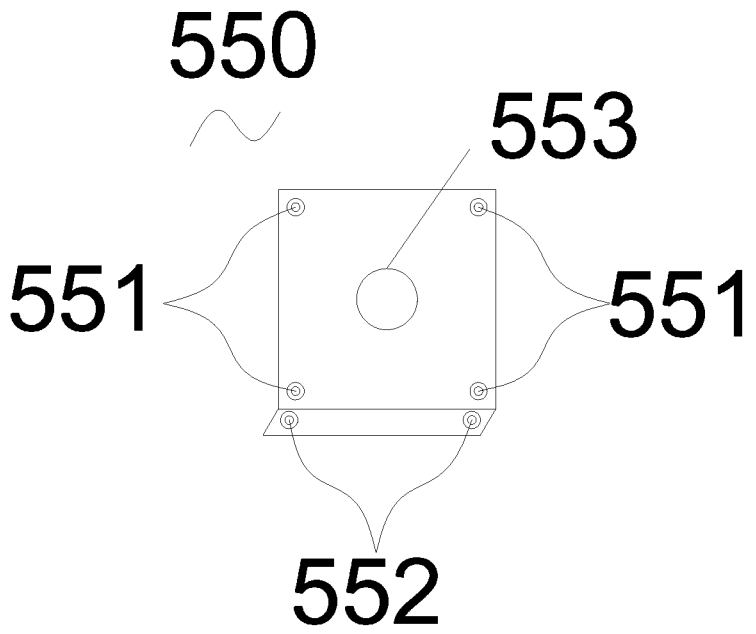
FIG. 7 is a schematic diagram of a structure of a first L-shaped fixing plate.
Figure 8:
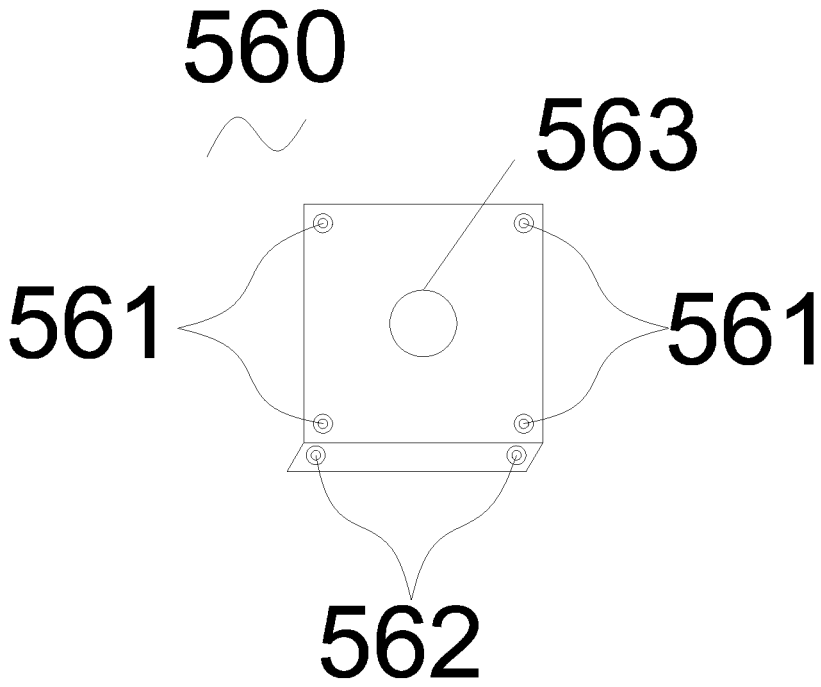
FIG. 8 is a schematic diagram of a structure of a second L-shaped fixing plate.

In the drawings: 10-device for grinding side surface of inner wall of rock borehole; 20-controller; 30-air pump; 39-air pressure valve; 70-direct current motor; 200-univeral drive joint; 300-grinding cylinder; 3000-base; 24-display; 23-first cable; 920-second cable; 930-displacement sensor hole; 940-displacement sensor; 21-third cable; 71-direct current motor hole; 72-direct current motor fixing hole; 73-direct current motor rotating shaft; 5100-first rotating shaft; 5200-second rotating shaft; 5110-first end steering gear threaded hole; 5120-second end steering gear threaded hole; 4100-first grinding head; 4200-second grinding head; 330-first grinding air pipe; 320-second grinding air pipe; 340-first grinding cylinder cavity; 350-second grinding cylinder cavity; 360-first cylinder piston; 370-second cylinder piston; 313-first grinding cylinder hole; 314-second grinding cylinder hole; 311-first grinding cylinder fixing hole; 312-second grinding cylinder fixing hole; 550-first L-shaped fixing plate; 551-first upper L-shaped fixing plate hole; 552-first lower L-shaped fixing plate hole; 560-second L-shaped fixing plate; 561-second upper L-shaped fixing plate hole; 562-second lower L-shaped fixing plate hole; 553-first connecting hole; 563-second connecting hole; 630-first linear bearing housing; 640-second linear bearing housing; 631-first linear bearing housing LM shaft; 641-second linear bearing housing LM shaft; 2300-first translation movable plate; 2310-first translation movable plate threaded hole; 2330-first translation movable plate perforation; 2430-second translation movable plate perforation; 2350-first translation movable plate perforation; 2450-second translation movable perforation; 2320-first translation movable plate fixing hole; 2400-second translation movable plate; 2340-first translation movable plate hole; 2440-second translation movable plate hole; 2410-second translation movable plate threaded hole; 2420-second translation movable plate fixing hole; 380-first reset spring; 390-second reset spring; 381-first grinding cylinder spring hole; 391-second grinding cylinder spring hole; 2360-first parallel movable plate hole; 2460-second parallel movable plate hole.

DETAILED DESCRIPTION OF THE EMBODIMENTS

To make the objectives, features and advantages of the present disclosure more understandably and apparently, the following further describes the present disclosure in detail with reference to the accompanying drawings and specific embodiments.

Please refer to FIG. 1, FIG. 2, FIG. 3, FIG. 4, FIG. 5, FIG. 6, FIG. 7 and FIG. 8, the present disclosure provides a device 10 for grinding a side surface of an inner wall of a rock borehole, which comprises a controller 20, an air pump 30, a direct current motor 70, a universal drive joint 200, a grinding cylinder 300, an L-shaped fixing plate, a linear bearing housing 600 including a first linear bearing housing 630 and a second linear bearing housing 640, a displacement sensor, translation movable plates, a base 3000, grinding heads 4000, and a right-angle drive steering gear 5000.

Specifically, the controller 20 is connected to the air pressure valve 39 by a third cable 21 to achieve the effect of accurate control and intelligent display. The air pressure valve 39 is connected to the air pump 30 by an air pipe, the controller 20 is connected to the direct current motor 70 by the first cable 23 through a direct current motor hole 71 so as to control the direct current control to drive the grinding heads to rotate. The base 3000 is rectangular, and the direct current motor 70 is threaded to the base 3000 by screws penetrating through a base fixing hole via direct current motor fixing holes 72. Both ends of the universal drive joint 200 are respectively connected to a direct current motor rotating shaft 73 and a second rotating shaft 5200 to guarantee that the direct current motor may still provide a rotating force for the right-angle drive steering gear when the right-angle drive steering gear moves. A first grinding head 4100 and a second grinding head 4200 are respectively connected to first rotating shafts 5100 by penetrating through a first translation movable plate hole 2340 and a second translation movable plate hole 2440 to guarantee that the direct current motor rotating shaft still provide rotating power when the right-angle drive steering gear moves, thereby making the grinding heads rotate to grind the curved surface of the borehole wall. The right-angle drive steering gear is fixed to the first translation movable plate 2300 and the second translation movable plate 2400 by screws respectively penetrating through a first translation movable plate threaded hole 2310 at an opposite position of the first translation movable plate 2300 and a second translation movable plate threaded hole 2410 at an opposite position of the second translation movable plate 2400 via a first end steering gear threaded hole 5110 and a second end steering gear threaded hole 5120, thereby guaranteeing that the right-angle drive steering gear moves along with the translation movable plates to achieve the purpose that the grinding cylinder drives the translation movable plates to move through the left-right movement of a cylinder shaft and then the translation movable plates, by driving the right-angle drive steering gears, drive the grinding heads to move left and right to grind the curved surface of the borehole wall. The grinding cylinder 300 is connected to a first upper L-shaped fixing plate hole 551 on a first L-shaped fixing plate 500 and a second upper L-shaped fixing plate hole 561 on a second L-shaped fixing plate 560 by screws via a first grinding cylinder fixing hole 311 and a second grinding cylinder fixing hole 312 in a one-to-one correspondence manner; a first lower L-shaped fixing plate hole 552 on the first L-shaped fixing plate 500 and a second lower L-shaped fixing plate hole 562 on the second L-shaped fixing plate 560 are connected to base fixing holes in a one-to-one correspondence manner to guarantee that the grinding cylinder is fixed to the base 3000. One end of the second grinding air pipe 320 is connected to the air pressure valve 39, and the other end of the second grinding air pipe is connected to a first grinding cylinder cavity 340 by penetrating through the base fixing hole and the corresponding first grinding cylinder hole 313 located at the bottom surface. One end of a first grinding air pipe 330 is connected to the air pressure valve 39, and the other end of the first grinding air pipe is connected to second grinding cylinder cavity 350 by penetrating through a base fixing hole and the corresponding second grinding cylinder hole 314 located at the bottom surface. One end of a first cylinder piston 360 is connected to the first grinding cylinder cavity 340, and the other end of the first cylinder piston penetrates through a first connecting hole 553 on the first L-shaped fixing plate 550 to be fixed to the first translation movable plate 2300 by a cap nut via a first translation movable plate hole 2320. One end of a second cylinder piston 370 is connected to the second grinding cylinder cavity 350, the other end of the second cylinder piston penetrates through a second connecting hole 563 on the second L-shaped fixing plate 560 to be fixed to the second translation movable plate 2400 by a cap nut via a second translation movable plate fixing hole 2420, it is guaranteed that the two pistons of the grinding cylinder operate independently, and the effect that the grinding cylinder drives the translation movable plate to move left and right, and then the grinding heads are driven to move to grind the cambered surface of the inner wall of the rock borehole so as to form two parallel circular planes with two symmetrical borehole axes inside the rock borehole is achieved. A first reset spring 380 and a second reset spring 390 are respectively arranged at both ends of the grinding cylinder 300. One end of the first reset spring 380 is fixed to the grinding cylinder by penetrating through a first grinding cylinder spring hole 381, and the other end of the first reset spring is fixed to the first translation movable plate by penetrating through a first parallel movable plate hole 2360. One end of the second reset spring 390 is fixed to the grinding cylinder by penetrating through a second grinding cylinder spring hole 391, and the other end of the second reset spring is fixed to the second translation movable plate by penetrating through a second parallel movable plate hole 2460. After the curved surface of the borehole wall is ground by the grinding heads, the cylinder is depressurized to a neutral position, and grinding parts are reset to an initial state by means of the reset springs. The displacement sensor is threaded to the grinding cylinder 300 by a screw penetrating through a grinding cylinder preformed hole via a displacement sensor hole. Both ends of the displacement sensor are fixedly connected to fixing strips through a sensor iron core, the fixing strips are tightly attached to side surfaces of the first cylinder piston 360 and the second cylinder piston 370. The fixing strips are fixed and are used to monitoring the displacement of the first cylinder piston 360 and the second cylinder piston 370 to determine position information of the grinding cylinder pistons and the ground planes. The outside of the displacement sensor is covered with a sealing cover. The sealing cover is fixed to the grinding cylinder by a nut penetrating through a sealing cover fixing hole and a corresponding grinding cylinder hole, and the sealing cover and a grinding cylinder are sealed with a sealing ring. The displacement sensor is connected to the controller 20 by a second cable 920 through the displacement sensor hole 930 so as to achieve the real-time monitoring and display of displacement measurement parameters. Both ends of a first linear bearing housing LM shaft 631 are threaded, and the first linear bearing housing LM shaft 631 respectively penetrates through a first translation movable plate perforation 2330 and a second translation movable plate perforation 2430 to be fixed to the first translation movable plate 2300 and the second translation movable plate 2400 by nuts. Both ends of a second linear bearing housing LM shaft 641 are threaded, and the second linear bearing housing LM shaft 641 respectively penetrates through a first translation movable plate perforation 2350 and a second translation movable plate perforation 2450 to be fixed to the first translation movable plate 2300 and the second translation movable plate 2400 by nuts to guarantee the linear movement of the first translation movable plate 2300 and the second translation movable plate 2400, thereby driving the grinding heads to move in a straight line to achieve the purpose of forming two parallel circular planes with two symmetrical borehole axes inside the rock borehole. The controller 20 comprises an input device (not shown in figure) and a display 24. The display may display air pressure parameter information and grinding head displacement parameter information. Therefore, an operator may more intuitively read or observe in real time the changes in the air pressure and displacement parameters during the whole process of grinding the side surface of the inner wall of the rock borehole, and the providing of the display 24 makes the use of the device 10 for grinding the side surface of the inner wall of the rock borehole more conveniently.

Figure 9:
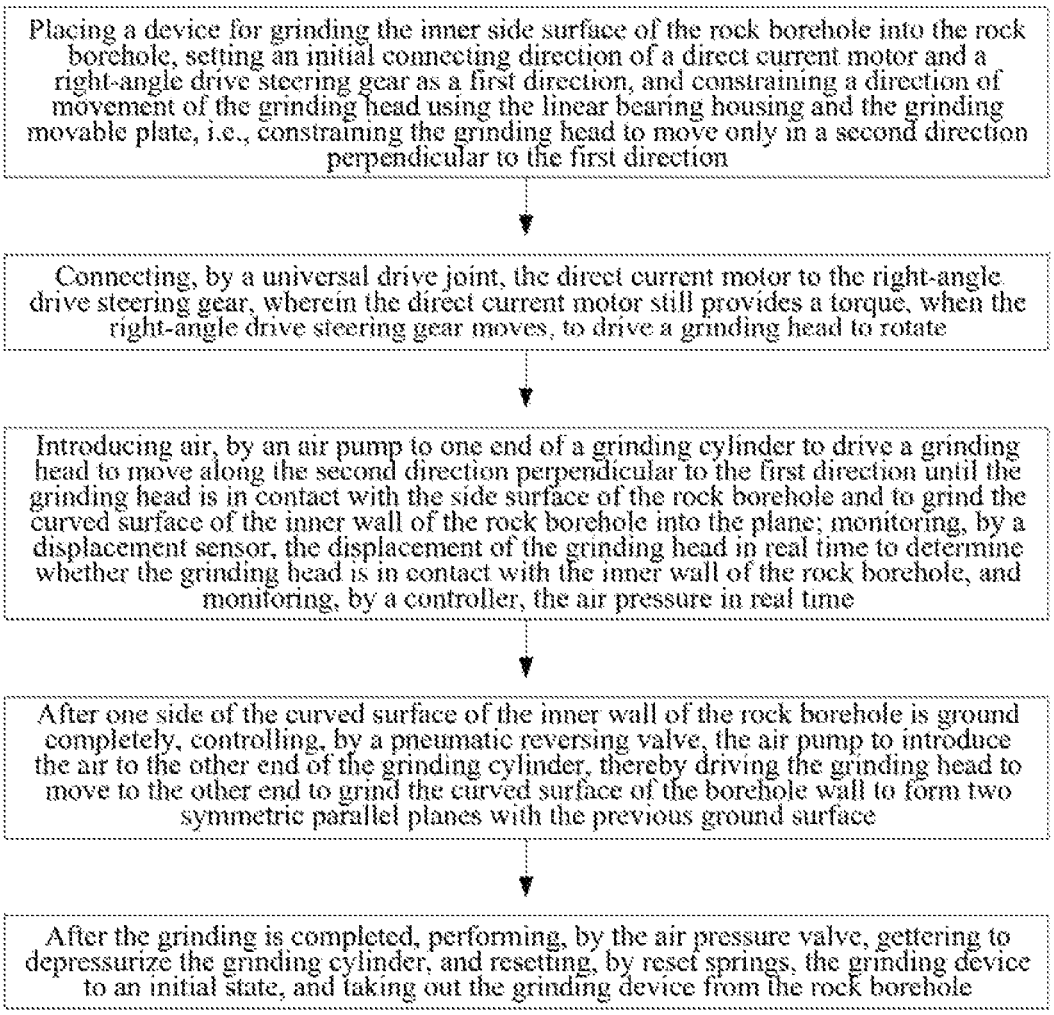
FIG. 9 is a flow diagram of a grinding method of a device for grinding an inner side surface of a rock borehole in accordance with the present disclosure.

In conjunction with FIG. 9, a method for grinding the inner side surface of the rock borehole for a rock borehole comprises the following flows: a device for grinding the inner side surface of the rock borehole is placed into the rock borehole, an initial connecting direction of a direct current motor and a right-angle drive steering gear is set as a first direction, and a direction of movement of the grinding head is constrained using the linear bearing housing and the translation movable plate, that is, the grinding head is constrained to move only in a second direction perpendicular to the first direction.

The direct current motor is connected to the right-angle drive steering gear by a universal drive joint, which still provides a torque, when the right-angle drive steering gear moves, to drive a grinding head to rotate.

An air pump introduces air to one end of a grinding cylinder to drive the grinding head to move along the second direction perpendicular to the first direction until the grinding head is in contact with the side surface of the rock borehole and to grind the curved surface of the inner wall of the rock borehole into the plane. The displacement of the grinding head is monitored in real time by a displacement sensor so as to determine whether the grinding head is in contact with the inner wall of the rock borehole, and the air pressure is monitored in real time by a controller.

After one side of the curved surface of the inner wall of the rock borehole is ground completely, the air pump is controlled by a pneumatic reversing valve to introduce air to the other end of the grinding cylinder, thereby driving the grinding head to move to the other end to grind the curved surface of the borehole wall to form two symmetric parallel planes with the previous ground surface.

After the grinding is completed, the air pressure valve is used for gettering to depressurize the grinding cylinder, the grinding device is reset by reset springs to an initial state, and then is taken out from the rock borehole.

In the description of the embodiments of the present disclosure, it needs to be noted that orientation or positional relationship indicated by "upper", "lower", "front", "rear", "left", "right", "horizontal", "inside", "outside" and the like is based on the orientation or positional relationship shown in the drawings only for convenience of description of the present disclosure and simplification of description rather than indicating or implying that the device or element referred to must have a particular orientation, be constructed and operate in a particular orientation, and thus are not to be construed as limiting the present disclosure. Furthermore, the terms "first", "second" and "third" are used for descriptive purposes only and are not to be construed as indicating or implying relative importance or implying a number of the indicated technical features.

Several examples are used for illustration of the principles and implementation methods of the present disclosure. The description of the embodiments is merely used to help illustrate the method and its core principles of the present disclosure. In addition, a person of ordinary skill in the art can make various modifications in terms of specific embodiments and scope of application in accordance with the teachings of the present disclosure. In conclusion, the content of this specification shall not be construed as a limitation to the present disclosure.

What is claimed is:

1. A device for grinding a side surface of an inner wall of a rock borehole, comprising a base, wherein a direct current motor is fixedly installed on the base, a right-angle drive steering gear comprises first rotating shafts and a second rotating shaft, one end of the direct current motor is electrically connected to a controller, and the other end of the direct current motor is in drive connection with the second rotating shaft of the right-angle drive steering gear by a universal drive joint, the universal drive joint is configured for connecting the other end of the direct current motor and the second rotating shaft of the right-angle drive steering gear; the controller is connected to an air pressure valve by a cable, and the air pressure valve is connected to an air pump by an air pipe; one end, away from the universal drive joint, of the right-angle drive steering gear is provided with a grinding cylinder, and the grinding cylinder is fixedly installed on the base; both sides of the right-angle drive steering gear are symmetrically provided with a first translation movable plate and a second translation movable plate, and cylinder pistons at both sides of the grinding cylinder are fixedly connected to the first translation movable plate and the second translation movable plate, respectively; one side of the right-angle drive steering gear is fixedly installed on the first translation movable plate, the other side of the right-angle drive steering gear is fixedly installed on the second translation movable plate; the first rotating shafts comprise a first shaft and a second shaft, wherein the first shaft extends from one side of the right-angle drive steering gear and the second shaft extends from an opposite side of the right-angle drive steering gear, and wherein the first shaft and the second shaft respectively penetrate through the first translation movable plate and the second translation movable plate and then are fixedly connected to grinding heads; the air pressure valve is connected to the grinding cylinder by a grinding air pipe; and a displacement sensor electrically connected to the controller is installed on the grinding cylinder.

2. The device for grinding the side surface of the inner wall of the rock borehole according to claim 1, wherein a first linear bearing housing and a second linear bearing housing are provided between the first translation movable plate and the second translation movable plate; the first linear bearing housing and the second linear bearing housing are fixedly installed on the base, and are respectively located at both ends of the grinding cylinder; both ends of a first linear bearing housing linear motion (LM) shaft are threaded, and the first linear bearing housing LM shaft respectively penetrates through the first translation movable plate and the second translation movable plate and are fixed to the first translation movable plate and the second translation movable plate; and both ends of a second linear bearing housing LM shaft are threaded, and the second linear bearing housing LM shaft respectively penetrates the first translation movable plate and the second translation movable plate and are fixed to the first translation movable plate and the second translation movable plate.

3. The device for grinding the side surface of the inner wall of the rock borehole according to claim 1, wherein an end part of each of the grinding heads is of a flat cylindrical structure, a tail part of each of the grinding heads is of a long cylindrical structure, a bottom area of the flat cylindrical structure at the end part of the grinding head is greater than that of the long cylindrical structure at the tail part of the grinding head, and the end part of the grinding head is fixedly connected to the right-angle drive steering gear rotating shaft through the tail part of the grinding head.

4. The device for grinding the side surface of the inner wall of the rock borehole according to claim 1, wherein the direct current motor is threaded to the base.

5. The device for grinding the side surface of the inner wall of the rock borehole according to claim 1, wherein the grinding cylinder is fixedly connected to the base through two symmetric L-shaped fixing plates; reset springs are respectively arranged at both ends of the grinding cylinder; one end of each reset spring penetrates through a grinding cylinder hole to be fixed to the grinding cylinder, and the other end of the reset spring penetrates through a first parallel movable plate to be fixed to the first translation movable plate or the second translation movable plate.

6. The device for grinding the side surface of the inner wall of the rock borehole according to claim 1, wherein the grinding cylinder is internally divided into a first grinding cylinder cavity and a second grinding cylinder cavity; the cylinder pistons located on both sides of the grinding cylinder are respectively located inside the first grinding cylinder cavity and the second grinding cylinder cavity, and the first grinding cylinder cavity is connected to the air pressure valve by a second grinding air pipe, and the second grinding cylinder cavity is connected to the air pressure valve by a first grinding air pipe.

7. The device for grinding the side surface of inner wall of the rock borehole according to claim 1, wherein the displacement sensor is threaded to the grinding cylinder and the displacement sensor is connected to the controller by a further cable through the displacement sensor hole.

8. The device for grinding the side surface of inner wall of the rock borehole according to claim 1, wherein the controller comprises an input device and a display, and the display is able to display air pressure parameter information and displacement parameter information of the grinding heads.

* * * * *